US009615700B2

(12) United States Patent
Woo et al.

(10) Patent No.: US 9,615,700 B2
(45) Date of Patent: Apr. 11, 2017

(54) URINAL WITH HAND WASHING FUNCTIONALITY

(71) Applicants: Jungmok John Woo, New York, NY (US); John J. Kwak, New York, NY (US)

(72) Inventors: Jungmok John Woo, New York, NY (US); John J. Kwak, New York, NY (US)

( * ) Notice: Subject to any disclaimer, the term of this patent is extended or adjusted under 35 U.S.C. 154(b) by 260 days.

(21) Appl. No.: 14/300,844

(22) Filed: Jun. 10, 2014

(65) Prior Publication Data

US 2014/0359929 A1 Dec. 11, 2014

Related U.S. Application Data

(60) Provisional application No. 61/833,022, filed on Jun. 10, 2013.

(51) Int. Cl.
*E03D 13/00* (2006.01)
*A47K 5/12* (2006.01)
*E03C 1/01* (2006.01)

(52) U.S. Cl.
CPC ..... *A47K 5/12* (2013.01); *E03C 1/01* (2013.01); *E03D 13/00* (2013.01)

(58) Field of Classification Search
CPC E03C 1/01; A47K 4/00; E03D 11/025; E03D 13/005; E03D 13/00; E03D 5/00; E03B 1/041; E03B 2001/045
USPC ..... 4/665
See application file for complete search history.

(56) References Cited

U.S. PATENT DOCUMENTS

| | | | | |
|---|---|---|---|---|
| 167,972 | A | 9/1875 | Ball | |
| 2,324,725 | A | 7/1943 | Rich | |
| 2,860,348 | A | 11/1958 | McClenahan | |
| 4,163,293 | A | 8/1979 | Basterfield | |
| 4,692,951 | A | 9/1987 | Taki | |
| 5,218,971 | A * | 6/1993 | Minami | A61B 5/208 235/375 |
| 5,522,096 | A | 6/1996 | Brown | |
| 5,813,047 | A | 9/1998 | Teichroeb | |
| 5,855,029 | A | 1/1999 | Flippen, Sr. | |
| 6,119,285 | A | 9/2000 | Kim | |
| 6,336,233 | B1 | 1/2002 | Shaw | |
| 6,425,148 | B1 | 7/2002 | Chen | |
| 7,331,068 | B1 | 2/2008 | Tichenor | |
| 2011/0047694 | A1 | 3/2011 | Dang | |
| 2012/0291195 | A1 * | 11/2012 | Courtney | A47K 10/48 4/638 |
| 2013/0019398 | A1 | 1/2013 | Selvaag | |

FOREIGN PATENT DOCUMENTS

| | | | |
|---|---|---|---|
| JP | 5-202547 | * | 8/1993 |

* cited by examiner

*Primary Examiner* — J. Casimer Jacyna
(74) *Attorney, Agent, or Firm* — Lucas & Mercanti, LLP

(57) ABSTRACT

The urinal incorporates hand washing functionality. Clean water is supplied from an array of holes or nozzles located in an overhang so that a user can wash their hands, and then the waste water is used to flush a urinal located below. The combination of these two functions in a single unit provides an inexpensive means for conserving water and efficiently using bathroom facilities while requiring less physical space than that needed for a separate urinal and hand washing station. The overhang can be retrofitted onto existing urinals.

14 Claims, 7 Drawing Sheets

URINAL WITH HAND WASHING FUNCTIONALITY

CROSS REFERENCE TO RELATED APPLICATION

This Application claims the priority of U.S. Provisional Patent Application No. 61/833,022 filed Jun. 10, 2013, the contents of which are incorporated by reference herein.

TECHNICAL FIELD

This invention relates to the field of baths, toilets and other plumbing fixtures. More specifically, the invention relates to an efficient urinal designed to save both water and physical space by incorporating hand washing functionality into a traditional urinal. In addition, the combined unit is economical to produce and allows for efficient utilization of bathroom facilities by eliminating the need for additional separate hand washing stations and the queuing necessitated by such configuration.

BACKGROUND OF THE INVENTION

A urinal is a receptacle used by men which collects urine in a basin and transfers it to a drainage system. A popular variant includes a flushing mechanism to clean the basin after use. Urinals are a common fixture in washrooms and are typically composed of ceramic materials with metallic embellishments, such as the drain cover and levers used to trigger the flushing mechanism. They may be freestanding or wall-mounted, and some variants use an extended design to accommodate multiple simultaneously users.

The standard urinal provides a fairly simple means for removing liquid waste. However, systems currently known in the art are generally wasteful with regard to water usage. After flushing the urinal, a user will customarily wash his hands in a nearby sink provided in the washroom.

Previous attempts have been made to combine a urinal with a hand washing station. Some of these urinals are awkward to use and overly complicated. For example, the apparatus disclosed in Ball, U.S. Pat. No. 167,972 (1875), which requires a complicated lever system to lift a hand washing basin out of the way of a lower urinal basin when the latter is in use. Similar designs are observed in the disclosures of Rich, Eckhardt and McClenahan; U.S. Pat. No. 2,324,725 (1943), U.S. Pat. No. 2,375,090 (1945), and U.S. Pat. No. 2,860,348 (1958), respectively. Each of these systems relies on the need for an upper basin for washing and a separate lower compartment to serve as the urinal basin. This configuration is inefficient in the sense that it requires extra complexity and additional parts.

More recent attempts have similarly failed to provide a solution as elegant and efficient as the present invention. For example, see Basterfield, U.S. Pat. No. 4,163,293 (1979) and Teichroeb, U.S. Pat. No. 5,813,047 (1998). Both require more elaborate systems involving additional piping and space requirements. Furthermore, each is designed to function with both urinals and toilets, and thus they are designed to utilize large volumes of water. Chen, U.S. Pat. No. 6,425,148 (2002) illustrates a similar approach, again using a design that treats the washing facility and toilet as separate units that are merely connected by shared piping.

An alternative approach is disclosed in Flippen, U.S. Pat. No. 5,855,029 (1999), which places the washing facility on an upper tier above a urinal basis such that water is transferred by gravity flow to be reused. However, Flippen is directed to a space-saving system as opposed to one that conserves water. This is reflected in the design, which while smaller than a traditional dual setup, still uses a significant amount of water and requires a tiered structure that may be awkward for users of varying heights.

Another compact system is disclosed in Kim, U.S. Pat. No. 6,119,285 (2000), Kim's design adds a hand washing function to, a standard urinal, but relies on a faucet-based design which directs the water vertically downward. Without the optional divider described in the preferred embodiment, Kim's approach results in splattering as water from the faucet strikes the bottom of the urinal, which is both unhygienic and a waste of water that would otherwise be used to flush and clean the basin.

SUMMARY OF THE INVENTION

Applicant recognizes that there is a need for a urinal that can reduce water usage while minimizing spatial requirements and complexity. There is further a demand to produce one that is hygienic and sturdy, as well as economical to produce. The conservation of clean water is an especially important objective given its increasing scarcity.

The present invention provides an improved urinal. The urinal of the present invention is superior to systems and designs known in the art in the fact that it conserves water and requires comparatively little space while also promoting cleanliness compared to similar models by way of reduced splashing of waste water. Furthermore, it promotes efficient use of limited bathroom facilities by eliminating the need for users to wait for access to a sink after using the urinal. Its simpler design requires relatively few parts, and yet provides equivalent sturdiness and improved functionality when compared to models known in the art. Furthermore, this simple design also allows a conventional urinal, with a few minor modifications to be utilized and obtain the present invention.

The design that allows for water to be conserved by way of the fact that water from the hand washing process is reused as a means to flush the urinal. This combination thus improves upon designs known in the art both in terms of water conservation and space saving, as the combined system occupies less physical space than a separate urinal and hand washing station. While previous attempts have been made to combine these two functionalities, systems known in the art are needlessly complicated in view of the design of the present invention, which carries out this function without requiring complicated plumbing.

In one aspect of the invention, the urinal is structured in the form of a typical urinal design well known in the art, with the addition an overhang projecting outward from the rear wall and holes located in the overhang to dispense a stream of water rearward towards the rear wall of the urinal. The plurality of holes are spaced a sufficient distance from the rear wall such that a user can place their hands in the stream of water without contacting the rear wall. The water then travels downward along the rear wall towards the drain by means of gravity and is thus reused to flush out the urinal. The holes are in fluid communication with a water source.

Because the hand washing holes direct the stream of water rearward, towards the rear wall of the urinal, the water first makes contact with the rear wall before making contact with the bottom wall and drain of the urinal.

The overhang can be a top wall of the urinal that projects outward from the rear wall of the urinal. The hand washing holes are positioned forward of the rear wall, preferably at the distal end of the top wall.

Alternatively, the overhang can be a pipe section that is spaced forward of the rear wall. The pipe section can be an L-shaped, T-shaped or U-shaped pipe section where the hand washing holes are positioned in the distal portion of the pipe section while the proximal portion of the pipe section is connected to the water source.

One of the advantages of the present Invention is that a conventional urinal can be retrofitted with the overhang in order to practice the present Invention. Thus, an installed urinal can be modified by the addition of the overhang, in order to practice the present invention.

The urinal of the present invention can also have conventional flushing holes that are positioned adjacent the rear wall and direct a stream of water vertically downward along the rear wall of the urinal. Such flushing holes can be used in addition to the hand washing holes that are positioned forward of the rear wall and direct a stream of water rearward, towards the rear wall.

The invention can be defined by one or more of the following paragraphs.

1. A urinal comprising:
(a) an outer housing comprising a rear wall having a top and bottom, a bottom wall projecting outward from the bottom of the rear wall, and two side walls projecting outward and abutting the rear wall and extending to the bottom wall;
(b) a basin cavity located within the outer housing and defined by the bottom wall, the rear wall, and the two side walls that transition to the rear wall;
(c) a drain in the bottom wall;
(d) an overhand projecting outward from the top of the rear wall;
(e) a plurality of holes located in the overhang, the plurality of holes connectable to a water supply, positioned forward of the rear wall, and oriented to direct a stream of water rearward, towards the rear wall such that there is sufficient space for hands of a user to be placed in the stream of water without contacting the rear wall; and
(f) a control means to activate the stream of water through the holes.

2. The urinal of 1 wherein the control means is a sensor unit that activates the stream of water when the user is detected in proximity to the urinal.

3. The urinal of 1 wherein the control means is a sensor unit that activates the stream of water when the user places his hands under the overhang.

4. The urinal of 1 wherein the control means is a manual control unit that activates the stream of water in response to manipulation of the manual control unit by a user.

5. The urinal of 1 further comprising a water tank located above the rear wall of the outer housing wherein the water tank is connected to the water supply and to the plurality of holes, and is capable of storing water for dispensing to the plurality of holes upon activation of the control means.

6. The urinal of 1 wherein the plurality of holes is oriented such that the stream of water leaves the plurality of holes at an angle of at least about 5° as measured from an imaginary vertical line extending downward from the plurality of holes.

7. The urinal of 1 wherein the plurality of holes is oriented such that the stream of water leaves the plurality of holes at an angle between about 5° and about 80° as measured from an imaginary vertical line extending downward from the plurality of holes.

8. The urinal of 1 wherein the plurality of holes is oriented such that the stream of water leaves the plurality of holes at an angle between about 20° and about 70° as measured from an imaginary vertical line extending downward from the Plurality of holes.

9. The urinal of 1 wherein the plurality of holes is positioned as a horizontal array parallel to the rear wall.

10. The urinal of 1 wherein the plurality of holes is positioned as two clusters and oriented such that the stream of water directed from each cluster is directed towards the center of the rear wall.

11. The urinal of 1 wherein the plurality of holes is positioned as more than two clusters and wherein each cluster can be activated independently by a control unit.

12. The urinal of 1 wherein a collection basin is positioned in the outer housing between the bottom wall and the top of the rear wall.

13. The urinal of 1 wherein the outer housing is affixed to a floor or affixed to a wall such that no part of the urinal contacts a floor.

14. The urinal of 1 further comprising a means for dispensing a soap or hand sanitizing agent.

15. The urinal of 1 wherein the overhang is a top wall of the urinal.

16. The urinal of 1 wherein the overhang is a pipe section having an L-shape, T-shape or U-shape.

17. The urinal of 1 wherein the plurality of holes comprises a plurality of nozzles.

18. The urinal of 17 wherein the plurality of nozzles can be adjusted, independently or as a group, to alter the direction, spray pattern or strength of the stream of water being dispensed.

19. The urinal of 17 wherein the plurality of nozzles can be articulated, independently or as a group, to adjust the direction of the stream of water being dispensed.

20. A urinal comprising:
(a) an outer housing comprising a rear wall having a top and bottom, a top wall projecting outward from the top of the rear wall, a bottom wall projecting outward from the bottom of the rear wall, and two side walls projecting outward and extending between the top wall and bottom wall;
(b) a collection basin located within the outer housing and defined by the top wall, the bottom wall, the rear wall, and the two side walls that transition to the rear wall, containing a series of channels at the position where the collection basin meets the rear wall that would allow a fluid to drain from the collection basin;
(c) a basin cavity located within the outer housing below the collection basin and defined by the top wall, the bottom wall, the rear wall, and the two side walls that transition to the rear wall;
(d) a drain in the bottom wall;
(e) a plurality of holes located in the top wall, the plurality of holes connectable to a water supply and positioned forward of the rear wall and oriented to direct a stream of water rearward towards the rear wall such that there is sufficient space for hands of a user to be placed in the stream of water without contacting the rear wall; and
(f) a control means to activate the stream of water through the holes.

Many advantages, features, and applications of the invention will be apparent from the following detailed description of the invention that is provided in connection with the accompanying drawings.

DETAILED DESCRIPTION OF THE INVENTION

Figure 1:
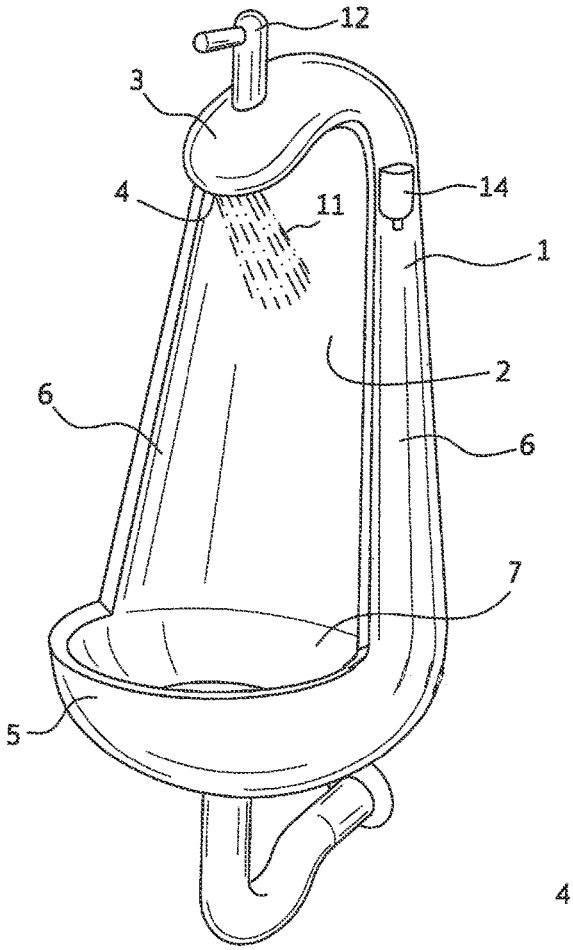
FIG. 1 is a perspective view of the urinal contemplated in this invention.
Figure 2:
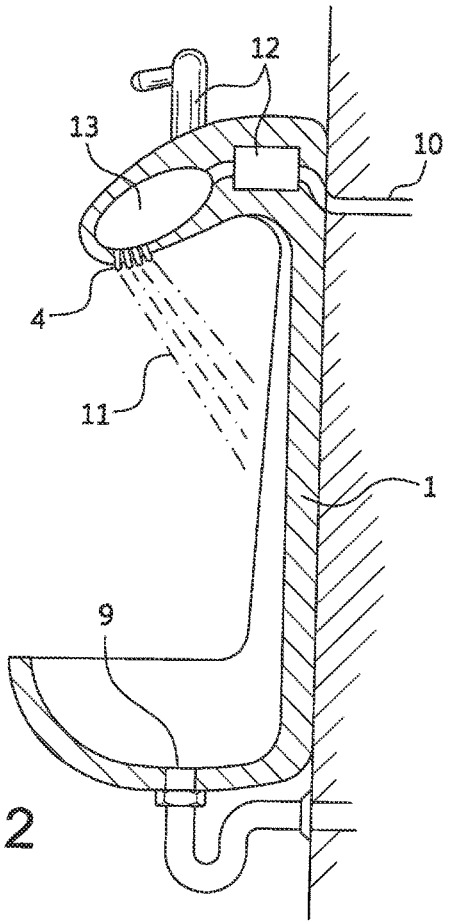
FIG. 2 is a sectional view cut along a vertical axis running through the urinal of FIG. 1 such that the urinal is bisected as two symmetrical halves.
Figure 4:
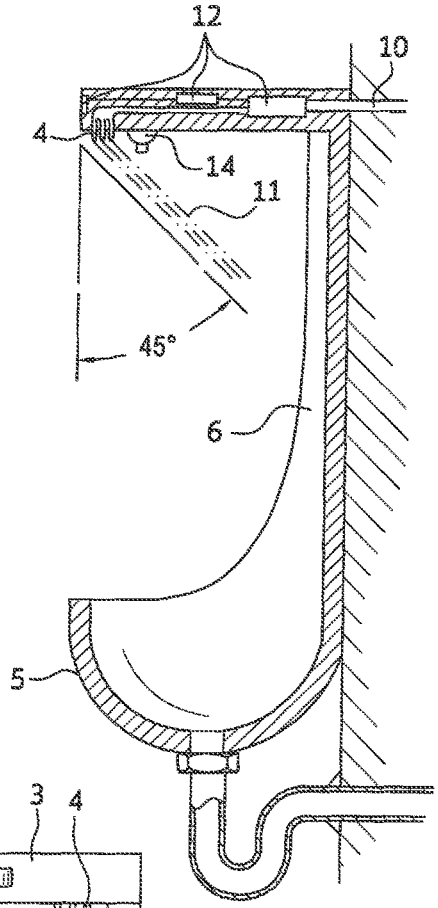
FIG. 4 is a sectional view cut along a vertical axis running through the urinal of FIG. 3 such that the urinal is bisected as two symmetrical halves.

Referring now to FIGS. 1 and 2, the urinal of the present invention is shown to be comprised of outer housing 1, which itself is comprised of rear wall 2 having a top and bottom, an overhang, shown as top wall 3, that projects outward from the top of rear wall 2 and which contains a plurality of holes 4 preferably located in proximity to its distal end, bottom wall 5 projecting outward from the bottom of the rear wall 2 and two side walls 6 projecting outward and extending between top wall 3 and bottom wall 5. A basin cavity 7 is located within the outer housing 1 and is defined by a drain 9 in the bottom wall 5, and shares the two side walls 6 of the outer housing 1 that transition into the rear wall 2. The plurality of holes 4 is connected to a water supply 10 and is positioned so that a stream of water 11 leaving each hole is directed backward towards the rear wall 2 such that a user of the urinal can place their hands in the stream of water 11 without contacting the rear wall 2. The stream of water 11 is generated upon activation of a control means 12, shown as a flush handle that directs water from the water supply 10 to the plurality of holes 4. The urinal can further include a soap dispenser or a hand sanitizer dispenser 14, see FIG. 4, preferably located in proximity to the plurality of water holes 4.

Figure 3:
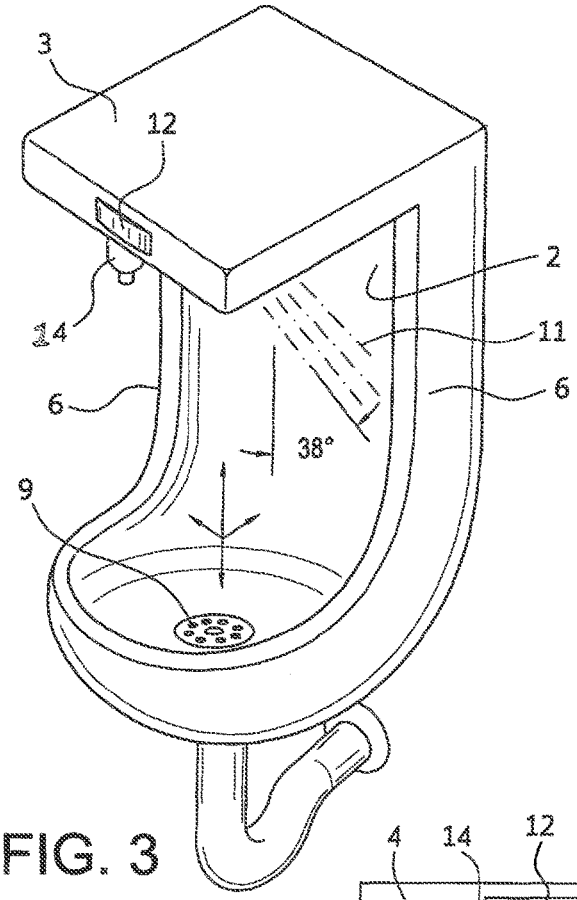
FIG. 3 is a perspective view of the urinal of this invention with a sensor control means.
Figure 10:
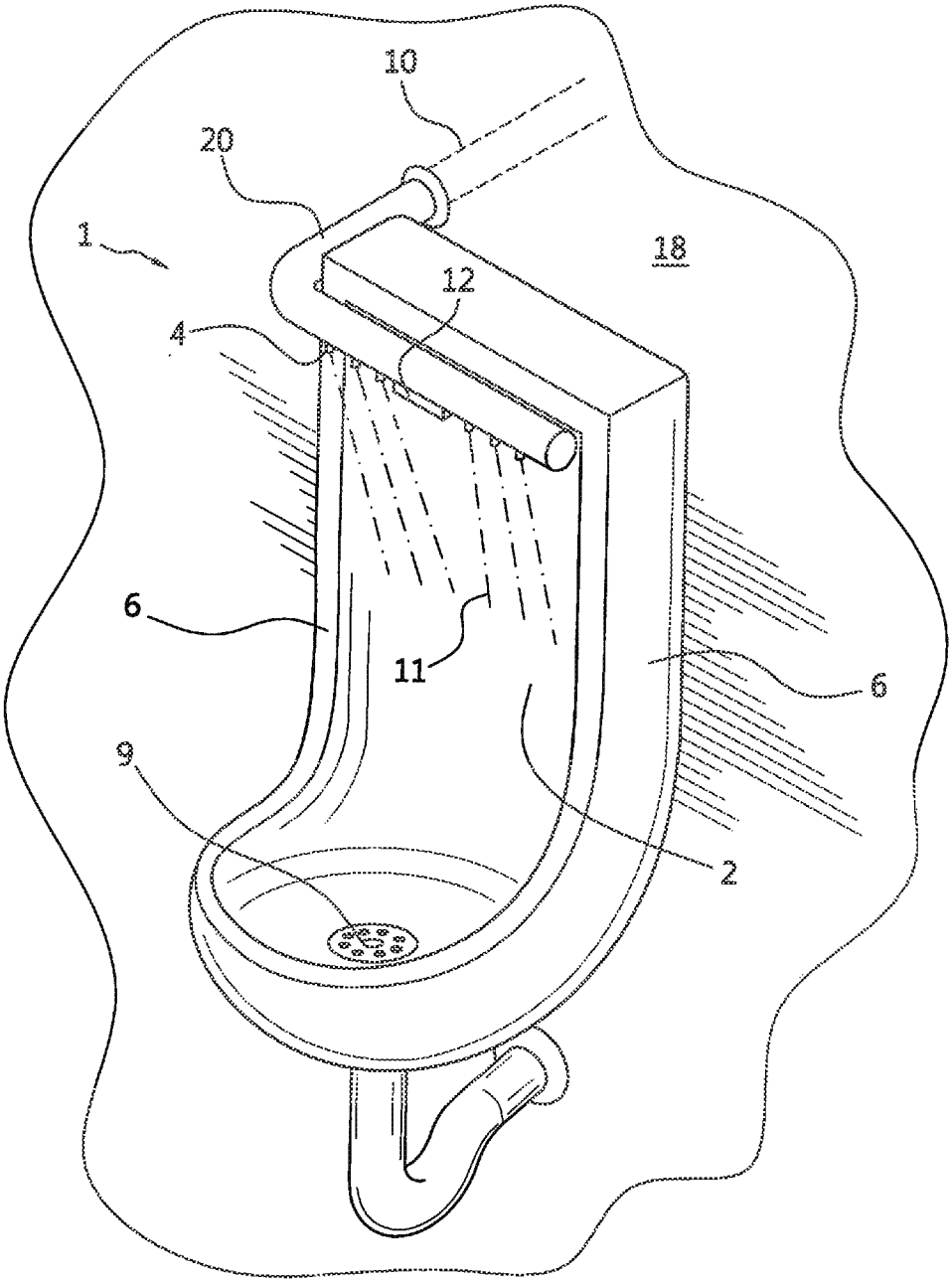
FIG. 10 illustrates a perspective view of the urinal of this Invention with an L-shaped pipe section.

The control means 12 can be a conventional manual lever, as shown in FIG. 1 or a switch or proximity sensor as shown in FIG. 3. It is understood that a variety of such means are well understood in the art and commonly used to control plumbing fixtures. The sensor can be located in the front of top wall 3, as shown in FIG. 3 or it can be located in the bottom of the overhang as shown in FIG. 10.

The invention can include a water tank 13 positioned between the plurality of holes 4 and the water supply 10, either before or after the point where the control means 12 is applied. This water tank 13 serves as a cistern to collect water for faster dispensation upon activation of the control means 12.

Figure 5:
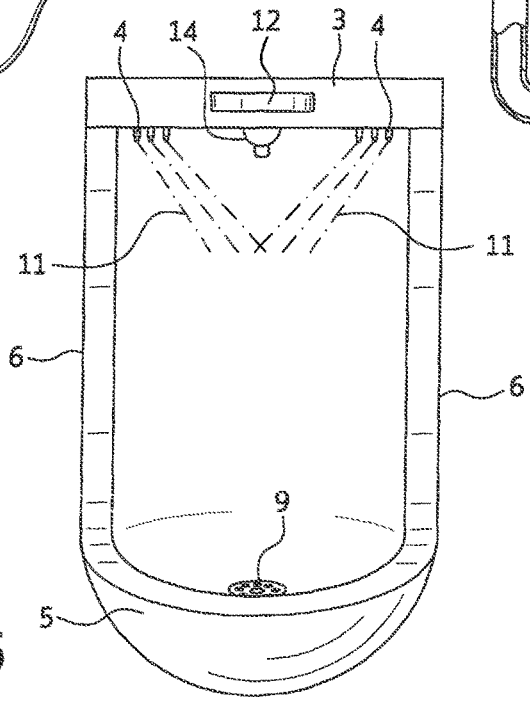
FIG. 5 is a front view of the urinal of this invention with clusters of hand washing holes.
Figure 6:
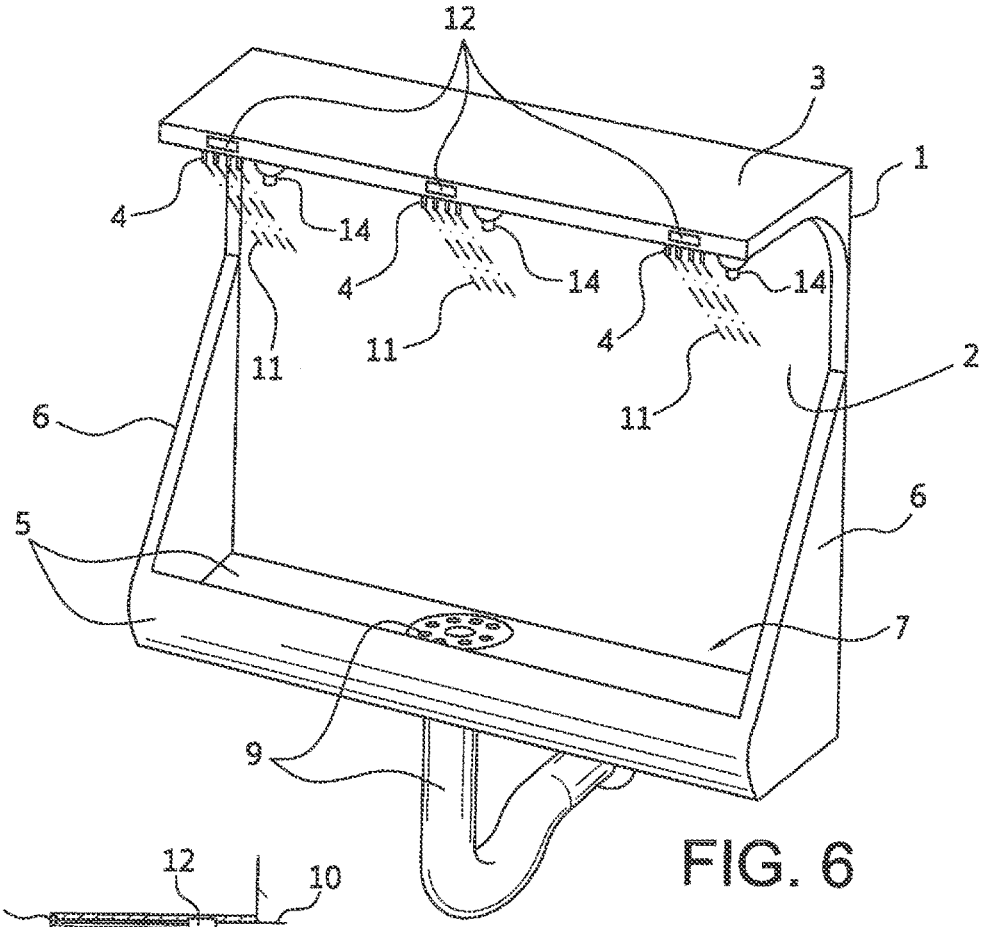
FIG. 6 is a front view of the urinal of this invention for multiple users.
Figure 7:
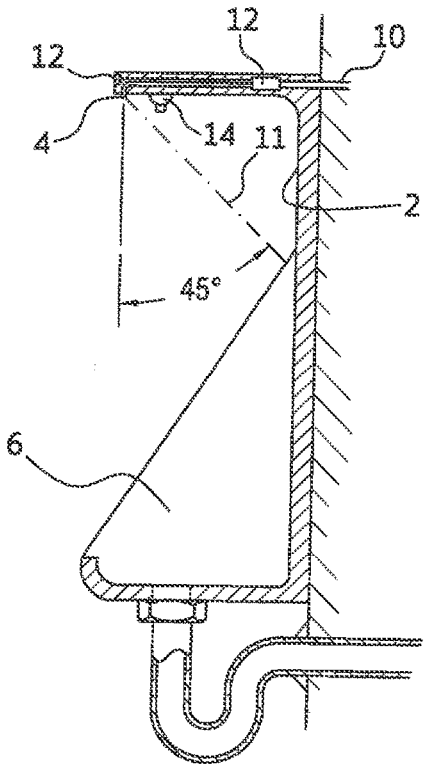
FIG. 7 is a sectional view cut along a vertical, axis running through the urinal of FIG. 6 such that the urinal is bisected as two symmetrical halves.

The plurality of holes 4 can be split into two or more clusters located in proximity to the distal end of the top wall 3 as shown in FIG. 5. In addition to directing the stream of water 11 to towards the rear wall 2, these holes may be articulated so that the stream of water 11 converges on its way towards the rear wall 2.

The top wall 3 can have a width at the distal end equal to that of the width of the rear wall 2. This allows the plurality of holes 4 to be arranged as a-horizontal array running parallel to the rear wall 2 as shown in FIGS. 3 and 8.

Figure 8:
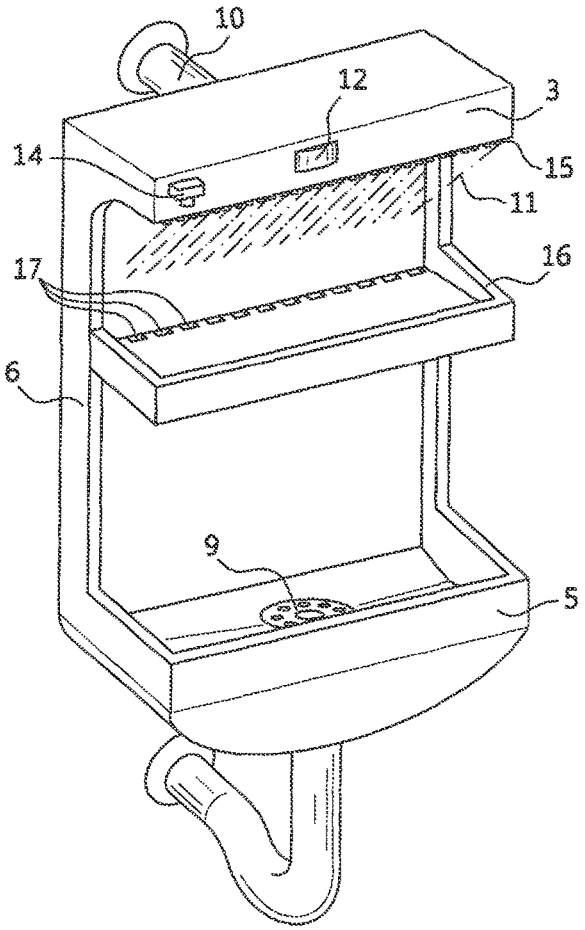
FIG. 8 is a perspective view of the urinal of this invention with a collection basin.
Figure 9:
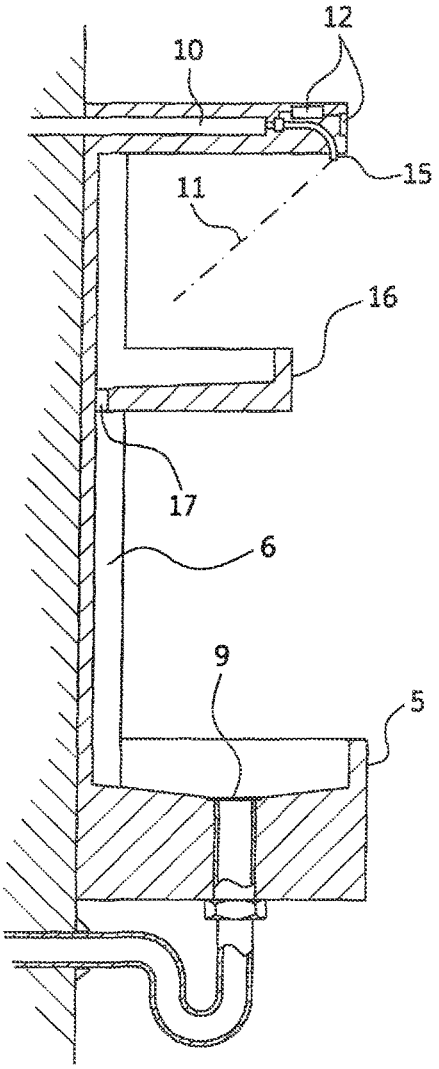
FIG. 9 is a sectional view cut along a vertical axis running through the urinal of FIG. 8 such that the urinal is bisected as two symmetrical halves.

The plurality of holes 4 can comprise a plurality of nozzles 15 as shown in FIGS. 8 and 9. Nozzles are understood to be a device designed to control the directions or characteristics of a fluid flow as it enters or exits an enclosed chamber. Typically, nozzles are designed in the form of a projecting spout. It is understood that a variety of nozzle designs are well understood in the art and commonly used to control the direction, intensity and spray pattern of liquid being dispensed from an enclosure.

Suitably, the plurality of nozzles 15 are adjustable. This can include nozzles that are rotatable along an axis so as to adjust the orientation or direction of the stream of water 11 exiting the plurality of nozzles 15. Adjustment can also include configurations where the plurality of nozzles 15 can be manipulated in order to adjust the aperture or shape of the nozzle, such an adjustment affecting the characteristics of the stream of water 11 being dispensed. It is understood that methods for designing adjustable nozzles are well known in the art. For example, designs wherein a rotation of the nozzle causes the aperture to change in size, increasing water pressure and thus intensity of the stream of water 11 exiting the nozzle. Similar means are known that can cause the stream of water 11 to take the form of a diffuse spray. It is further contemplated that adjustment may include a means for adjusting individual nozzles independently or a means for adjusting multiple nozzles simultaneously.

Since a nozzle can create a spray similar to the plurality of holes, a single nozzle with a single hole connectable to the water supply can be used to practice the present Invention.

As shown in FIGS. 8 and 9, a collection basin 16 positioned between the top wall 3 and bottom wall 5, projecting outward from the rear wall 2, sharing the two side walls 6 of the outer housing 1 that transition into the rear wall 2. The collection basin 16 is understood to have a at least one channel 17 located on the rear side of the collection basin 16 where it contacts the rear wall 2 so as to allow water that accumulates in the collection basin to flow downward through the at least one channel 17 along the rear wall 2 leading to the basin cavity 7. Preferably, there is an array of channels 17 arranged so that water draining through the channels comes in contact with a majority of the surface of the rear wall 2 located below the collection basin 16. It is also preferred that the collection basin 16 is angled rearward such that water flows towards the rear wall.

The combined urinal and hand washing fixture described in the present invention may be constructed as a free standing or wall-mounted structure, as with other urinal designs well known in the art. Similarly, the commonly used ceramic and metallic components favored in urinal design and known in the art of plumbing and, fixture design are also adequate construction materials. It is understood that other materials and configurations known in the art may be substituted.

Additionally, the overhang can be retrofitted to an existing urinal to practice the present Invention.

FIG. 10 illustrates outer housing 1 mounted on wall 18 and L-shaped pipe section 20 with a proximal end connected to water supply 10 and distal end with holes 4 overhanging the top of rear wall 2. Control means 12, shown as a sensor, is located on the bottom side of pipe section 20. Control means 12 opens a valve in water supply 10 to create stream of water 11 when a user places his hands in close proximity to the sensor.

Figure 11:
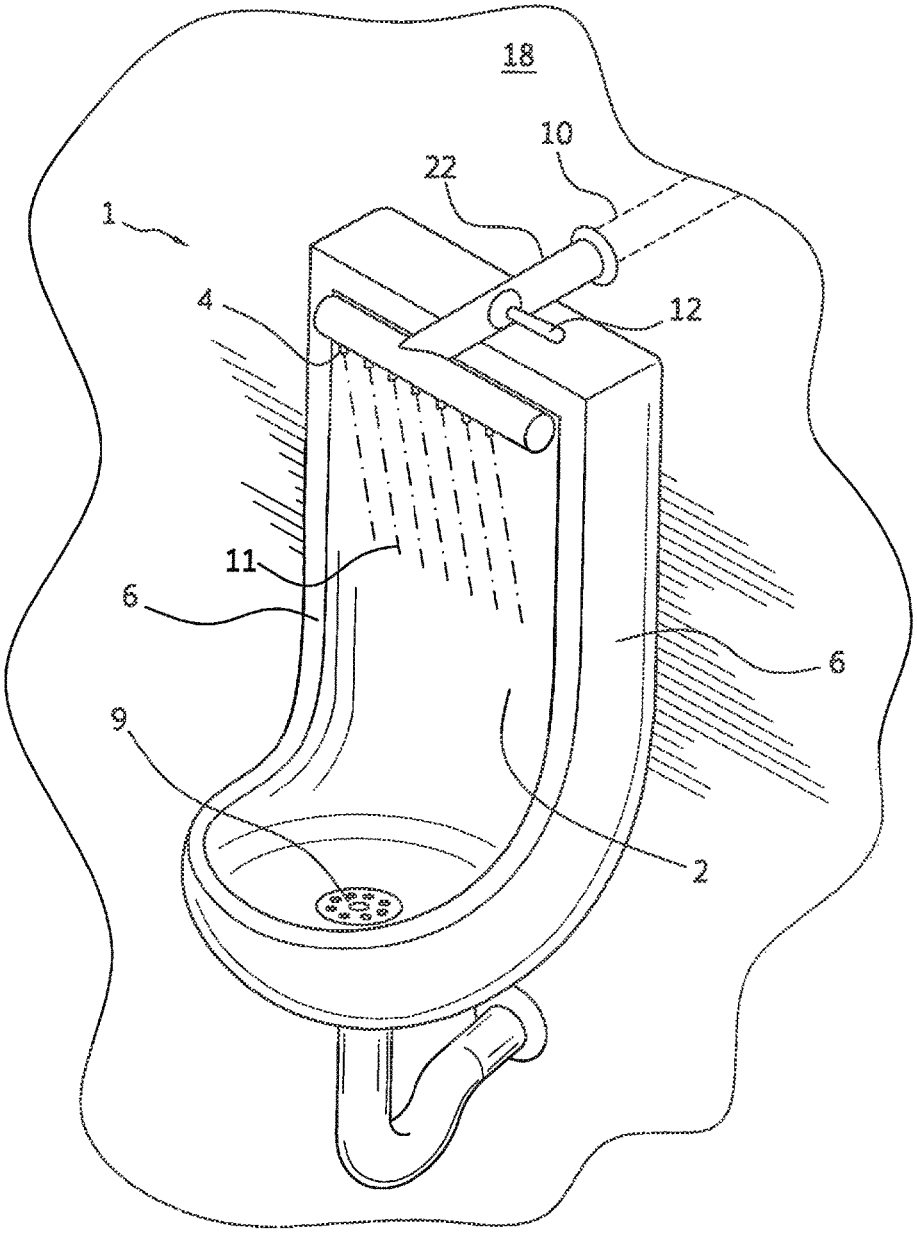
FIG. 11 illustrates a perspective view of the urinal of this invention with a T-shaped pipe section.

FIG. 11 illustrates outer housing 1 mounted on wall 18 and T-shaped pipe section 22 with proximal end connected to water supply 10 and distal end with holes 4 overhanging the top of rear wall 2. Control means 12 is shown as a conventional handle valve in the T-shaped pipe section 22.

Figure 12:
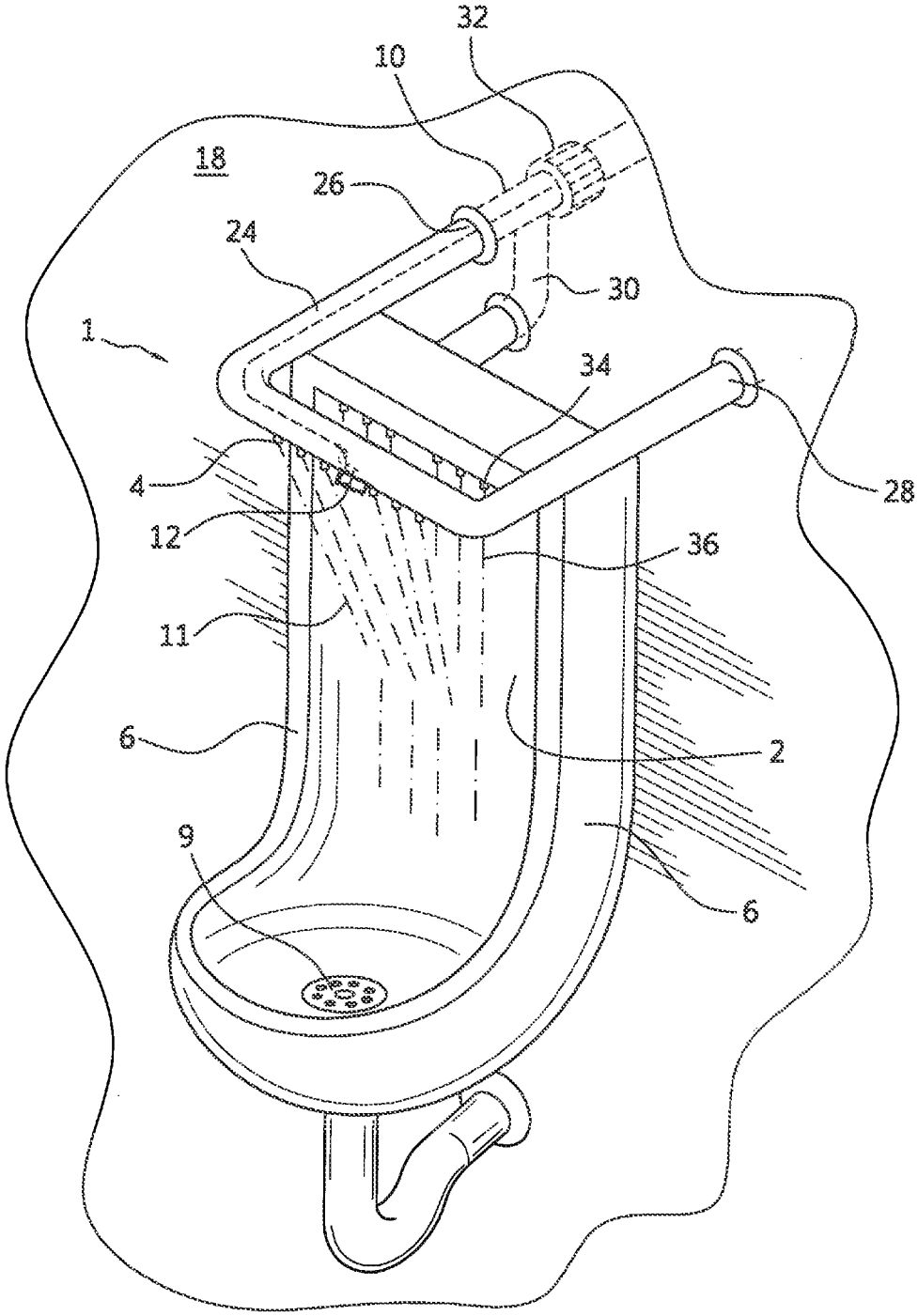
FIG. 12 illustrates a perspective view of the urinal of this invention with a U-shaped pipe section.

FIG. 12 illustrates outer housing 1 mounted on wall 18 and U-shaped pipe section 24 with one proximal ends 26 connected to water supply 10 and the other proximal end 28 mounted to the wall 18 for support. The distal end of U-shaped pipe section 24 has holes 4 and overhanging the top of rear wall 2. Pipe connection 30 connects water supply 10 to conventional flush holes 34 located adjacent to rear wall 2 for directing a stream of water 36 vertical downward along rear wall 2. Control means 12 positioned on the bottom of U-shaped pipe section 24 is connected electrically to valve 32. Control means 12 senses when a user places his hands under the sensor for washing. When the sensor senses hands, then valve 32 is opened so water flows through both flushing holes 34 and hand washing holes 4. Thus, two streams of water merge and flow through housing 1 to drain 9.

While particular examples of the present invention have been shown and described, it is apparent that changes and modifications may be made therein without departing from the invention in its broadest aspects. The aim of the appended claims therefore is to cover all such changes and modifications that fall within the true spirit and scope of the invention.

REFERENCE CHARACTERS

1. outer housing
2. rear wall
3. top wall
4. holes
5. bottom wall
6. side wall
7. basin cavity
8. (unused)
9. drain
10. water supply
11. stream of water
12. control means
13. water tank
14. soap dispenser
15. nozzles
16. collection basin
17. channel
18. wall
19. (unused)
20. L-shaped pipe section
22. T-shaped pipe section
24. U-shaped pipe section
26. one proximal end of U-shaped pipe section
28. another proximal end of U-shaped pipe section
30. pipe connection
32. valve
34. stream along rear wall

The invention claimed is:

1. A urinal comprising:

(a) an outer housing comprising a rear wall having a top and bottom, an overhang projecting outward from the top of the rear wall, a bottom wall projecting outward from the bottom of the rear wall, and two side walls projecting outward and abutting the rear wall and extending to the bottom wall;

(b) a single uninterrupted basin cavity located within the outer housing and defined by the overhang, the bottom wall, the rear wall, and the two side walls that transition to the rear wall;

(c) a single drain, wherein the drain is located in the bottom wall;

(d) a plurality of holes located in the overhang having a direct line-of-sight with the rear wall, the plurality of holes connectable to a water supply and positioned to direct a stream of water rearward towards the rear wall such that there is sufficient space for hands of a user to be placed in the stream of water for hand washing without contacting the rear wall, wherein the plurality of holes is oriented such that the stream of water leaves the plurality of holes at an angle between about 20° and about 80° as measured from an imaginary vertical line extending downward from the plurality of holes and wherein a single stream of water is provided to the basin cavity for hand washing and flushing the urinal; and (e) a controller to activate the stream of water through the holes.

2. The urinal of claim 1 wherein the controller is a sensor unit that activates the stream of water when the user is detected in proximity to the urinal.

3. The urinal of claim 1 wherein the controller is a sensor unit that activates the stream of water when the user places his hands under the overhang.

4. The urinal of claim 1 wherein the controller is a manual control unit that activates the stream of water in response to manipulation of the manual control unit by a user.

5. The urinal of claim 1 further comprising a water tank located above the rear wall of the outer housing wherein the water tank is connected to the water supply and to the plurality of holes, and is capable of storing water for dispensing to the plurality of holes upon activation of the controller.

6. The urinal of claim 1 wherein the plurality of holes is oriented such that the stream of water leaves a plurality of holes at an angle between about 20° and about 70° as measured from an imaginary vertical line extending downward from the plurality of holes.

7. The urinal of claim 1 wherein the plurality of holes is positioned as a horizontal array parallel to the rear wall.

8. The urinal of claim 1 wherein the outer housing is affixed to a floor or the outer housing is affixed to a wall such that no part of the urinal is in contact with a floor.

9. The urinal of claim 1 further comprising a soap dispenser or hand sanitizing agent dispenser.

10. The urinal of claim 1 wherein the overhang is a top wall of the urinal.

11. The urinal of claim 1 wherein the overhang is a pipe section having an L-shape, T-shape or U-shape.

12. The urinal of claim 1 wherein the plurality of holes comprises a plurality of nozzles.

13. The urinal of claim 12 wherein the plurality of nozzles can be adjusted, independently or as a group, to alter the direction, spray pattern or strength of the stream of water being dispensed.

14. The urinal of claim 12 wherein the plurality of nozzles can be articulated, independently or as a group, to adjust the direction of the stream of water being dispensed.

* * * * *